US006843283B2

(12) United States Patent
Dietrich

(10) Patent No.: US 6,843,283 B2
(45) Date of Patent: Jan. 18, 2005

(54) METHOD AND INSTALLATION FOR EMPTYING CASKS

(75) Inventor: Frédéric Dietrich, 7, rue Voltaire, 1006 Lausanne (CH)

(73) Assignees: Frédéric Dietrich, Morrens (CH); Yves Dietrich, Morrens (CH)

( * ) Notice: Subject to any disclaimer, the term of this patent is extended or adjusted under 35 U.S.C. 154(b) by 0 days.

(21) Appl. No.: 10/451,087

(22) PCT Filed: Dec. 18, 2001

(86) PCT No.: PCT/IB01/02523

§ 371 (c)(1),
(2), (4) Date: Jun. 17, 2003

(87) PCT Pub. No.: WO02/49920

PCT Pub. Date: Jun. 27, 2002

(65) Prior Publication Data

US 2004/0040617 A1 Mar. 4, 2004

(30) Foreign Application Priority Data

Dec. 19, 2000 (FR) ..... 00 16595

(51) Int. Cl.[7] ..... B65B 1/04

(52) U.S. Cl. ..... 141/10; 141/65; 141/89; 141/91; 141/286; 141/314; 141/316

(58) Field of Search ..... 141/4, 7, 8, 10, 141/65, 89–91, 93, 97, 114, 270, 286, 313–316, 369–376, 284; 406/151–153

(56) References Cited

U.S. PATENT DOCUMENTS 3,061,165 A * 10/1962 Rench et al. ..... 206/524.8
4,182,386 A * 1/1980 Alack ..... 141/83
4,991,633 A * 2/1991 Wong ..... 141/5
5,682,929 A 11/1997 Maginot et al.
5,791,123 A * 8/1998 Bolz ..... 53/434
5,944,455 A 8/1999 Wilhelm
6,036,408 A * 3/2000 Wilhelm et al. ..... 406/113

FOREIGN PATENT DOCUMENTS

WO WO 82 04242 A 12/1982

OTHER PUBLICATIONS

International Search Report in SN PCT/IB01/02523.

* cited by examiner

*Primary Examiner*—Timothy L. Maust
(74) *Attorney, Agent, or Firm*—Bugnion S.A.; John Moetteli

(57) ABSTRACT

The invention concerns an installation for emptying casks (1) equipped with an external bag (11) and an internal bag (12) containing powdery products. It comprises a glove box (12) consisting of a bell made of a transparent material. It is provided, on its upper part, with an opening for the passage of a suction rod (3, 31, 32) equipped with sealing means between said pipe and the bell. The lower part of the bell is provided with means adapted to be urged in sealed position on the upper part of a cask (1). The bell (2) is suspended to a frame (5, 15) for its vertical displacement.

13 Claims, 6 Drawing Sheets

1
2
3
6
11
11'
12
24
25
29

1
2
3
6
11
12
29

METHOD AND INSTALLATION FOR EMPTYING CASKS

BACKGROUND OF THE INVENTION

The present invention relates to an installation for emptying casks equipped with a double internal bag comprising an outer bag and an inner bag containing powdery products and to a method for using said installation.

PRIOR ART

For the chemical industry, and more particularly the pharmaceutical industry, the confinement of products has always been a fundamental problem. During the last ten years, the products used by this industry, in particular powdery products, have been constantly increasing in their toxicity and in their reactivity. Furthermore, the production standards relating to quality result in the confinement of such products being unavoidable.

Confinement is also a necessity for both ecological reasons and for protecting the health of operators and, furthermore, to prevent the product from coming into contact with the ambient atmosphere and being contaminated. The operators have, up until the present time, been protected by clothing and gas masks or similar apparatuses. However, this solution is not satisfactory because is makes manipulations difficult and unpleasant. Furthermore, this solution protects neither the products nor the environment: it is therefore necessary to make use of more sophisticated systems. In such systems, complex ventilation and filtration systems are often resorted to. Installations comprising glove boxes have been used. A glove box is a closed enclosure provided with openings leading to the inside of gloves through which the operators try to manipulate the product that are inside a cubicle, for example by taking a cask, emptying it into another device for the manufacture of a product or for transferring it by means of an appropriate installation to a precise place. This type of installation is extremely costly and the manipulations of the casks is rather difficult using installations with gloves which, of course, make satisfactory confinement possible. This type of installation, called an isolating installation is not necessarily the best solution particularly when the powder must be loaded into an item of equipment such as, for example, a reactor, a dryer, etc, whose accessibility is poor and it is difficult to place such an isolating installation above the apparatus or the machine.

SUMMARY OF THE INVENTION

The purpose of the present invention is to propose an installation combining the advantages of a glove box and a powder transfer system in order to carry out such operations whilst ensuring the confinement of the product and also the protection of the operator and of the environment.

The invention also relates to a method of using this installation.

The installation for emptying casks according to the invention is characterized by the characterizing clause of claim 1.

The advantage of the installation according to the invention is the fact that, on the one hand, it is easy to place a glove box, which has already proved itself, on a cask provided with two internal bags, one of which is outside the other, to use a suction rod for sucking up the product and, consequently and still by manipulating through the glove box, to put another cask in place of the first one and to use it in a very flexible manner.

According to a variant embodiment, the lower part of the bell comprises a flat surface fitted on its lower face with a flat seal making it possible, during the positioning of the glove box on the cask, to ensure the sealing between the two of them, said flat surface being provided with an annular opening formed from a holding ring provided with means of holding the upper part of the bags.

The method according to the invention is defined in claim 6.

BRIEF DESCRIPTION OF THE DRAWINGS

The invention will be described in greater detail with reference to the appended drawings.

DETAILED DESCRIPTION OF THE PREFERRED EMBODIMENTS

Figure 1:
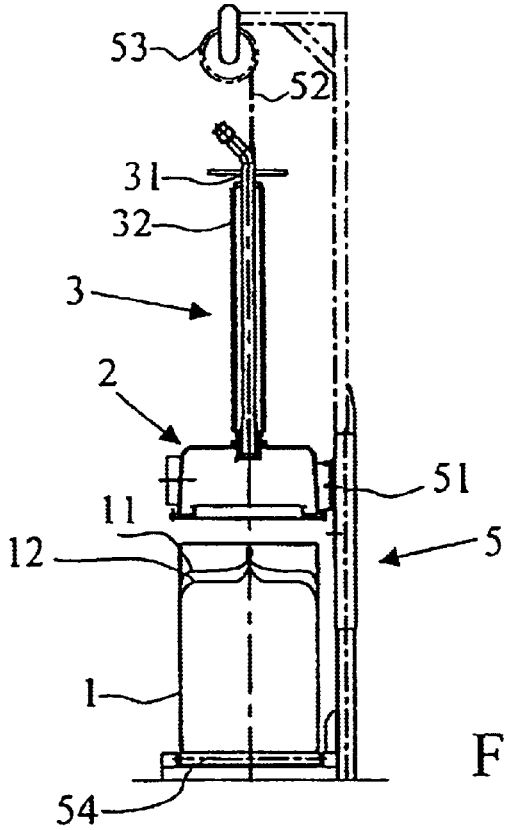
FIG. 1 is a diagrammatic side view of the installation according to the invention.

FIG. 1 shows a cask containing the powdery product to be emptied, the bell 2, the suction rod 3 and a support chassis 5.

The cask 1 comprises, inside of it, two bags 11 and 12, in principle made of a plastic material, each one closed independently: the bag 11 will be called the outer bag and the bag 12 will be called the inner bag. These two bags make it possible to confine the powdery product even after opening the cask, that is to say after having removed its lid. The glove box 2 is fixed to a support 51 of the chassis 5 which can be displaced in the vertical direction. The suction rod 3 is suspended by a flexible link 52 and a pulley 53 from the chassis 5 in order to allow the withdrawal of the rod or its insertion during the various stages of the method. The chassis 5 has a flat surface provided with rollers 54 facilitating the displacement of the casks and in particular their positioning under the glove box 2.

The suction rod essentially comprises a pipe 31 connected to a suction device making it possible to transfer the product from the cask to another reservoir or directly into the reactor or device in which the product must be used. The pipe 31 is surrounded by a flexible sleeve 32 closed at its upper end and being connected in a sealed manner to the upper part of the glove box 2, as will be seen below, thus making it possible to ensure the sealing of the installation.

Figure 2:
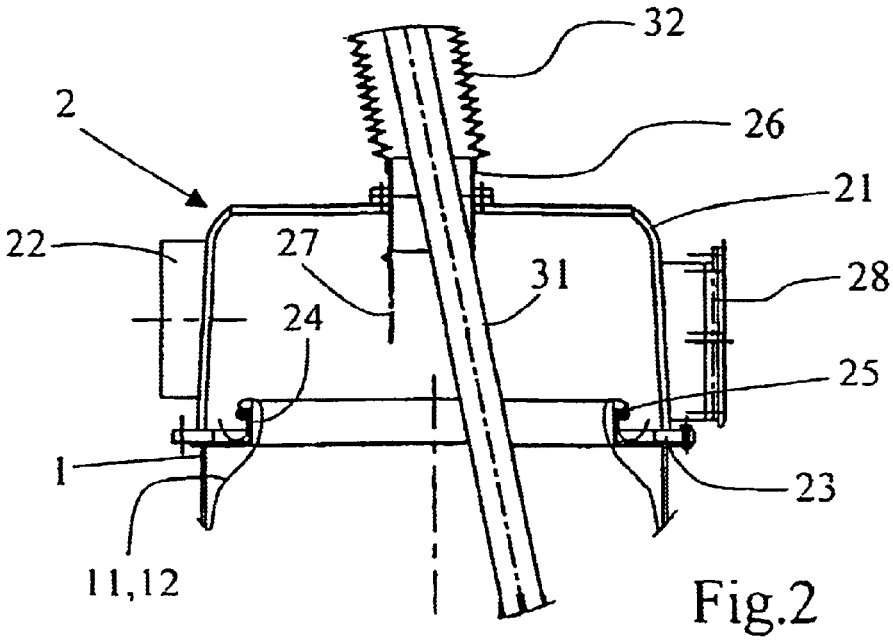
FIG. 2 is an enlarged view of the bell placed on a cask.

Reference will now be made to FIG. 2 in order to describe the glove box in detail. The glove box comprises a bell-shaped part 21 made of a transparent material, for example acrylic glass, through which the operator can see and monitor the emptying operations. It is also possible to have a bell made of stainless steel fitted with a part made of transparent material to make it possible to see inside the bell during its use. Two openings 22 placed on the side surface of the bell make it possible to install gloves fitted in a sealed manner into these openings which allow the manipulation of the various items inside the bell. The upper part of the bell is provided with an opening 26 through which passes the suction rod 3 and, in particular, the pipe 31, while the flexible sleeve 32 is fixed in a sealed manner onto the upper part of the opening 26. It is possible, in an optional manner, to provide this opening with a valve 27 in order to be able to close it when the rod, and in particular the pipe 31, are in a separated position such as shown for example in FIG. 1 or 2. The lower part of the glove box has a holding ring made of stainless steel 24 forming an annular opening on the lower part of the bell 23 which is flat. The flat surface 23 is provided with a flat seal via which it is placed on the upper part of the cask. The radial width of this flat surface makes it possible to adapt the glove box to casks whose diameters may be different, the essential point being that the bell can stand on the upper edge of the cask via the flat seal thus ensuring sealing. The ring 24 is provided with one or two retaining rings 25 which will be used for holding, as will be explained below, the two bags 11, 12 located inside the cask 1. The glove box is provided with a fixing device 28 by means of which this glove box is connected to the vertical displacement device 51 of the chassis 5.

Figures 3, 4, 5, 6:
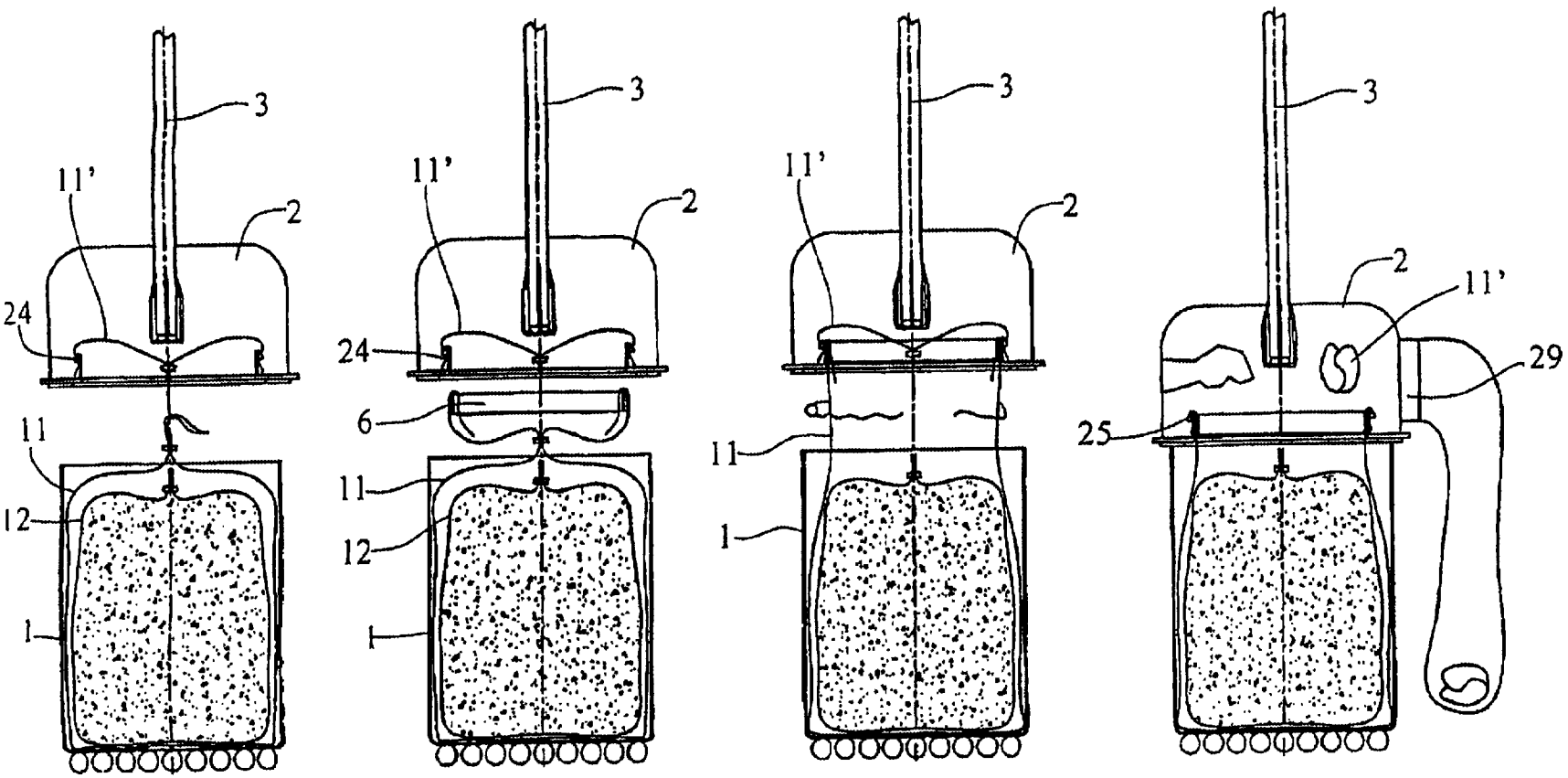
FIGS. 3–13 are partial views of the installation illustrating the stages of the method.
Figures 7, 8, 9, 10:
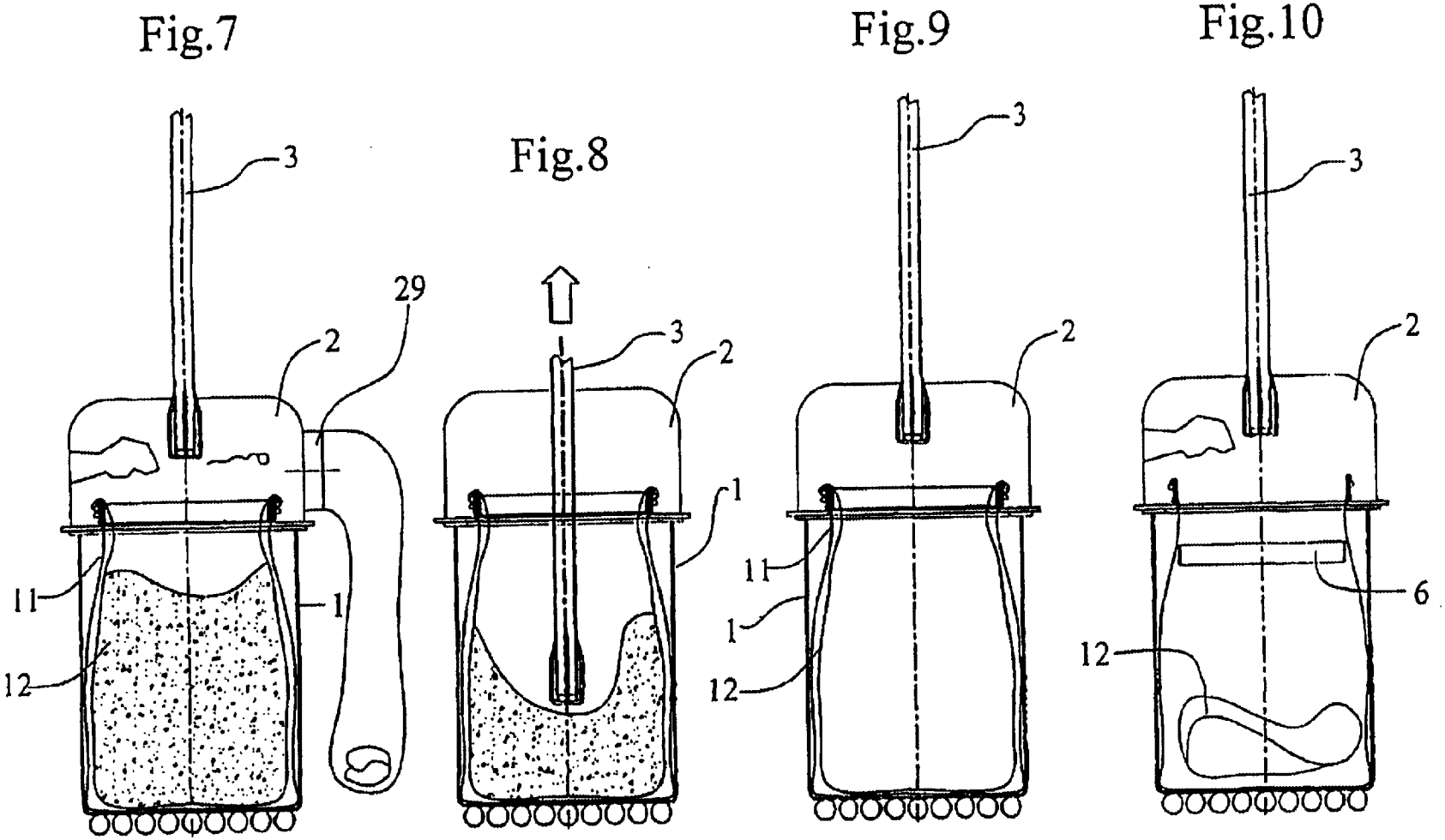
Figure 11:
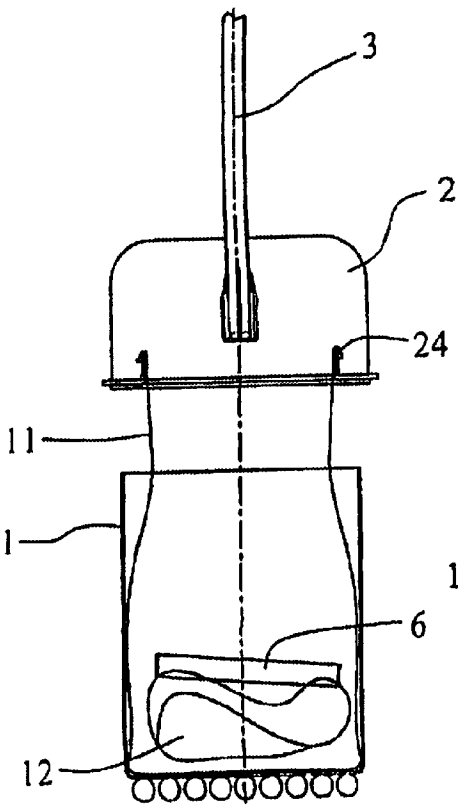
Figure 12:
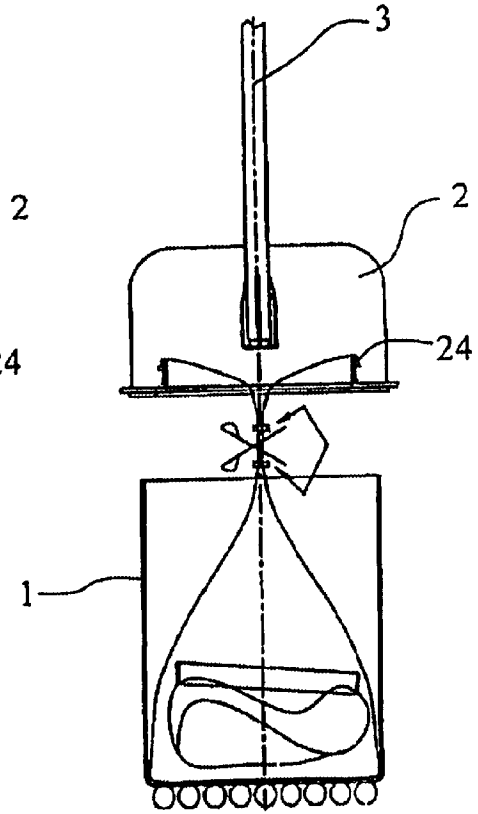
Figure 13:
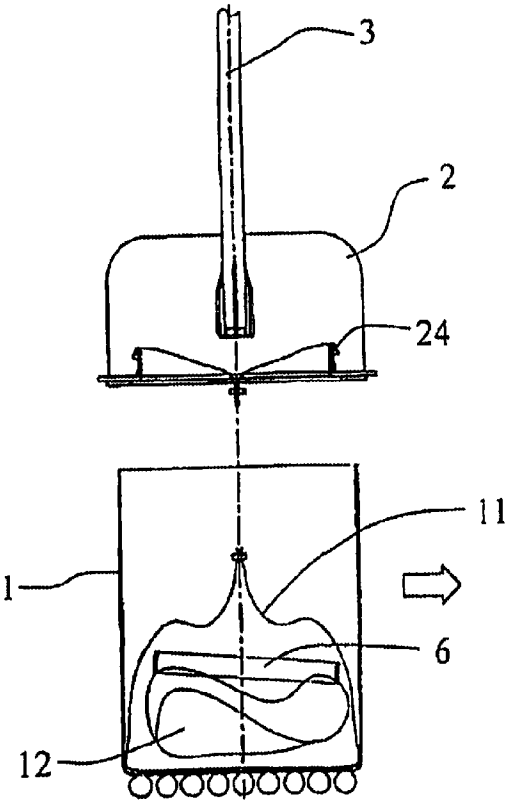

The method of using this installation will now be described with reference to FIGS. 3 to 13. The operator starts by removing the lid from the cask 1, opening the outer bag 11 and slipping a disposable sealing ring 6 (FIG. 4) inside. The sealing ring 6 is positioned inside the holding ring 24 and the outer bag 11 is opened (FIG. 5) by removing the flexible tie. Up until this stage, no contact with the product located inside the cask is possible since the inner bag 12 is still closed. Subsequently, the glove box 2 is lowered onto the cask, as shown in FIG. 6, and the operator places his hands in the gloves of the glove box in order to remove the upper part of the bag 11' that remained during the emptying of the preceding cask and to throw it through an opening 29 of the bell and into a sack. In order to continue, the upper edge of the outer bag 11 is fixed to the holding ring 24 by means of an O-ring (FIG. 2). Then he opens the second bag 12 (FIG. 7) and he throws the flexible tie through the opening 29 and ensures that the upper part is also held over the holding ring 24 with the same O-ring or with a second one. From this moment, the product can be sucked up, which is carried out by lowering the suction rod (FIG. 8) and by guiding it inside the cask in order to be able to suck up the product from the smallest recesses to be found inside. The operator, during this phase, manipulates the suction rod without being in contact with the product which is confined inside the glove box-cask installation and without wearing special clothing or equipment.

When the cask is completely empty (FIG. 9), the rod 3 is raised and the operator inserts his hands in the glove box (FIG. 10) and releases the upper part of the inner bag 12 which falls inside the outer bag 11 together with the disposable ring 6. Then the suction rod and glove box assembly (FIG. 11) is raised up to a certain height making it possible to have access to the upper part of the outer bag 11. Using two ties (FIG. 12), the upper part of the bag 11 is tied at two places separated in the vertical direction and the bag is then cut between the two ties (FIGS. 12 and 13), which makes it possible for the lower part of the bag 11, which is closed, to drop inside the empty cask while the upper part of the bag 11, also closed and isolated, remains on the ring 24. No leakage of the product is able to contaminate either the operator or the environment of the installation.

Subsequently, the empty cask is taken away and a new cask is brought in and the same operations as before (FIG. 2 onwards) are started again.

When the product to be transferred contains solvent or when it can react on contact with air or with moisture, the installation can be placed in a nitrogen atmosphere.

Figure 14:
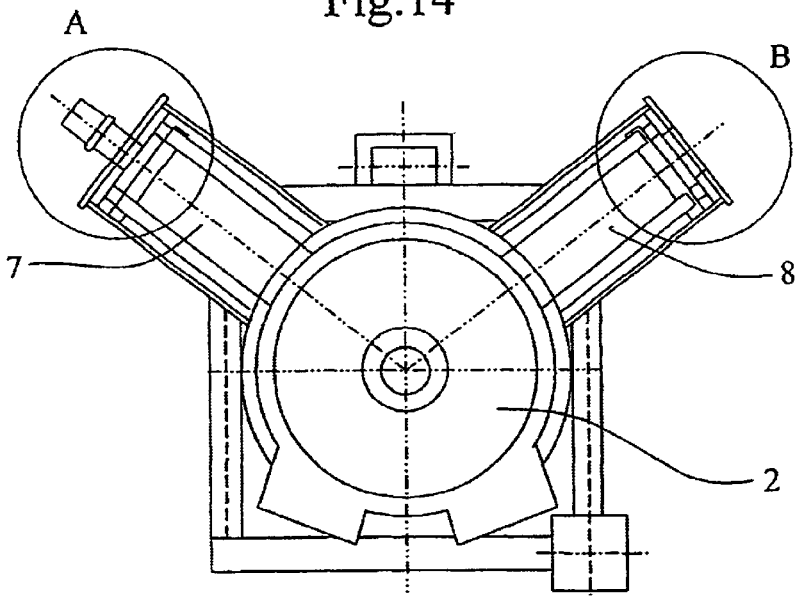
FIG. 14 is a plan view of the bell.
Figure 15:
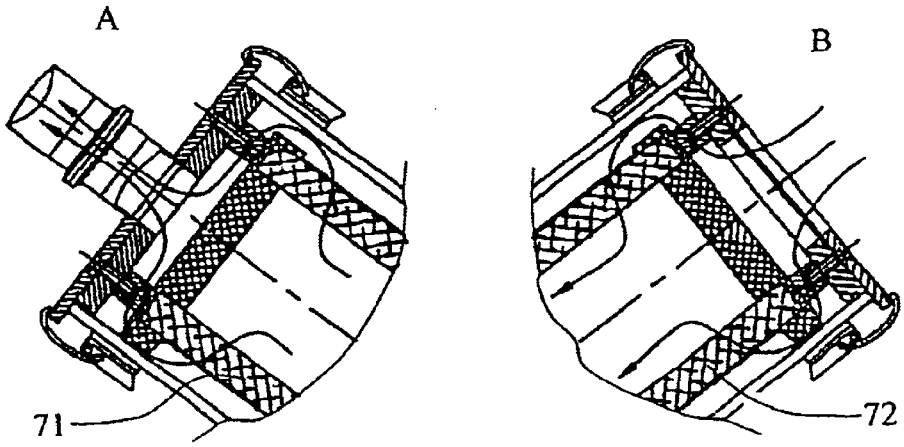
FIG. 15 is a cross-sectional view of two filters.

In order to ensure that work is carried out inside the installation under a slight depression, the bell 2 (FIG. 14) is provided with two openings on the side surface provided with two smooth tubes 7, 8. Each tube is provided with a filter 71, 72 fitted in a sealed manner. By means of a ventilation circuit, a flow of air (or of nitrogen if appropriate) is provided between the two filters in order to create a slight depression inside of the installation and to avoid any leakage of the product in the event of a manipulation error or another problem. These filters 71, 72 are standard filtering cartridges of the "push through" type, that is to say it suffices to push the new cartridge onto the old one in order to position it, the old one falling into the glove box so that it can be removed through the opening 29. FIG. 15 partially illustrates the flow of air (or of nitrogen) through the filters 71, 72.

Figure 16:
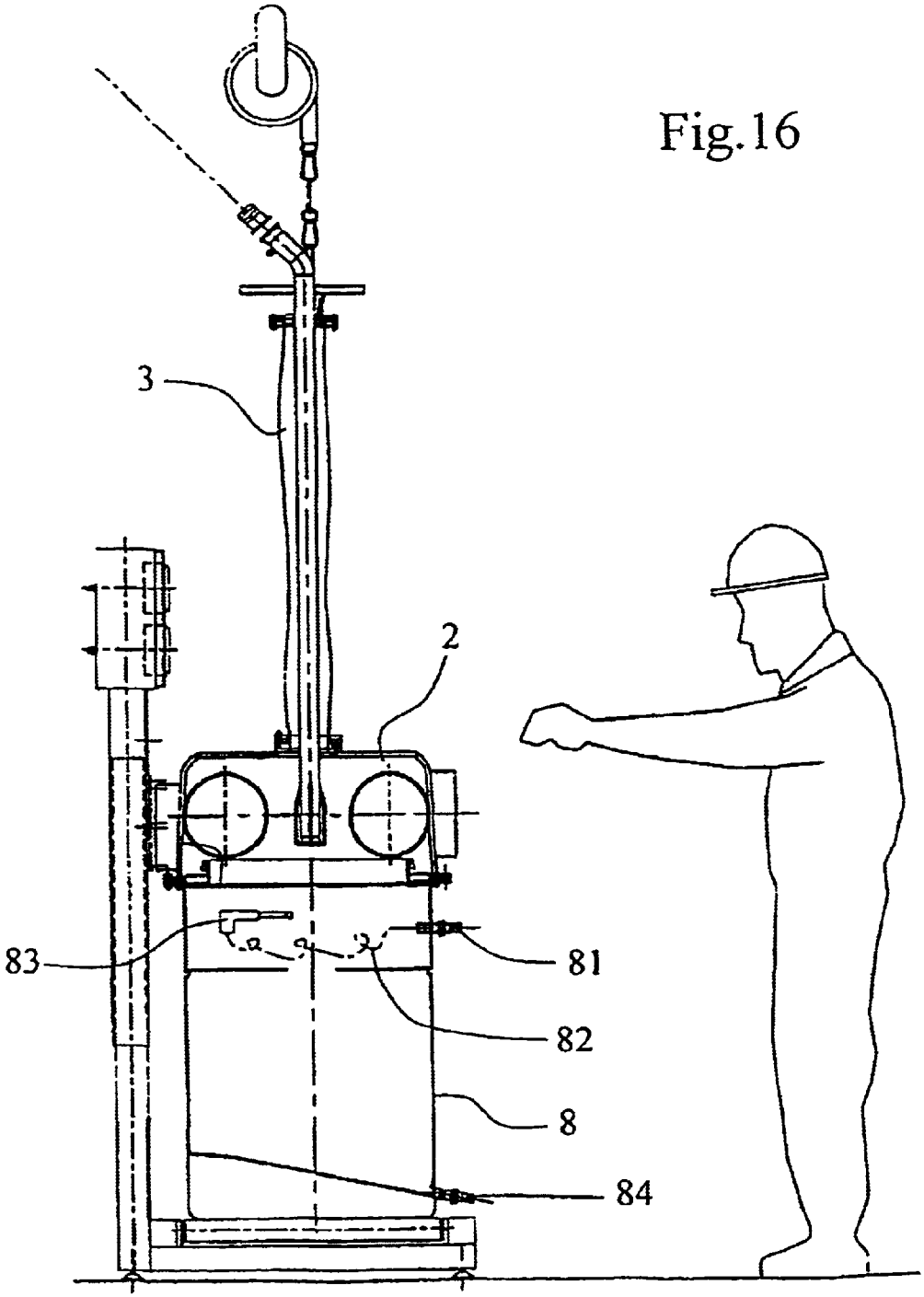
FIG. 16 is a diagrammatic view of the cleaning device.

Finally, FIG. 16 is a diagrammatic representation of a system for cleaning the installation, that is to say the bell and the rod. There is positioned a cask 8 provided with an inlet 81 for the cleaning liquid followed by a hose 82 whose end carries a spray gun 83. The cask 8 comprises a drainage opening 84. The bell is placed on the cask 8, the ducts of the two filters are closed and cleaning is carried out by spraying. To clean the rod 3, the cleaning liquid is made to flow between the cover 32 and the pipe 31. After the cleaning, the liquid is drained into a pit or a suitable container.

The installation described is very flexible as it can be moved and used with different equipment. Furthermore, it is possible to install it on a weighing device thus making it possible to check the quantity of product sucked up.

The glove box can easily be adapted to different diameters, or even different cask geometries by changing the face 23.

Depending on the product to be transferred, it is possible to carry out the transfer in an inert atmosphere.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. An installation adapted for emptying casks equipped with a double internal bag comprising an outer bag and an inner bag containing powdery products, the installation comprising a glove box comprised essentially of a bell at least partially made of a transparent material and provided with a lower, cask interface and an upper suction rod opening equipped with a sealing device which seals between said rod and the bell, and wherein the lower cask interface is provided with sealing interface adapted for interfacing with an upper part of a cask in a sealed manner and wherein a retaining device holds upper parts of the outer and inner bags, after they have been opened, against the lower cask interface.

2. The installation as claimed in claim 1, wherein the lower cask interface comprises a flat surface provided with a flat seal fitted thereto in order to ensure sealing with the cask prior to being processed, said flat surface being provided with an annular opening formed from a holding ring provided with the retaining device.

3. The installation as claimed in claim 1 wherein the glove box and the suction rod are mounted on a chassis designed to be able to raise and lower the glove box and suction rod assembly above a cask to be processed.

4. The installation as claimed in claim 1, wherein the glove box is provided with a filtering device making it possible to keep the installation under a vacuum.

5. The installation as claimed in claim 4, wherein the filtering device comprises two openings on a side surface of the bell, the openings being provided with two smooth tubes in which a filter is fitted in a sealed manner and wherein further, the two tubes are connected to an air circulation system.

6. The installation as claimed in claim 1, wherein it comprises a system for cleaning the bell comprising a cask provided on its upper part with an inlet for the cleaning liquid into a hose fitted with a spray gun.

7. The installation as claimed in claim 1, wherein the glove box is provided with an opening for removing the waste of the bags when changing the cask.

8. A method of using the installation as claimed in claim 1, and which comprises the following steps: the cask to be processed is opened by removing its lid and it is placed under the glove box, a disposable sealing ring is inserted in the upper part of the outer bag and it is inserted in the ring of the bell, the outer bag is opened, the glove box is lowered onto the cask until it is in sealed contact with the cask, using the gloves the outer bag is fixed to the holding ring by means of the sealing ring, the inner bag is opened and it is also fixed to the holding ring, the hands are withdrawn from the gloves and the cask is processed using the suction rod, when the cask is empty the gloves are used to detach the inner bag and it is allowed to drop inside the cask with the sealing ring, the glove box is raised over a predetermined height while keeping the outer bag on the holding ring and the bag is closed at two axially separated places using two ties, the bag is cut between these two places, the lower part of the bag is dropped into the cask with the upper part remaining on the glove box, the empty cask is removed, a new cask is brought into position and the same method is started again except that, before fixing the outer bag on the holding ring, the remaining part of the preceding bag is removed through the opening of the glove box.

9. The method as claimed in claim 8, wherein the transfer is carried out in a nitrogen atmosphere.

10. An installation adapted for emptying casks equipped with a double internal bag comprising an outer bag and an inner bag containing powdery products, the installation comprising a glove box comprised essentially of a bell at least partially made of a transparent material and provided with a lower, cask interface and an upper suction rod opening equipped with a sealing device which seals between said rod and the bell, and wherein the lower cask interface is provided with means adapted for interfacing with an upper part of a cask in a sealed manner and wherein a retaining device holds upper parts of the outer and inner bags, after they have been opened, against the lower cask interface, wherein the lower cask interface comprises a flat surface provided with a flat seal fitted thereto in order to ensure sealing with the cask prior to being processed, said flat surface being provided with an annular opening formed from a holding ring provided with the retaining device.

11. An installation adapted for emptying casks equipped with a double internal tag comprising an outer bag and an inner bag containing powdery products, the installation comprising a glove box comprised essentially of a bell at least partially made of a transparent material and provided with a lower, cask interface and an upper suction rod opening equipped with a sealing device which seals between said rod and the bell, and wherein the lower cask interface is provided with means adapted for interfacing with an upper part of a cask in a sealed manner and wherein a retaining device holds upper parts of the outer and inner bags, after they have been opened, against the lower cask interface, wherein the glove box and the suction rod are mounted on a chassis designed to be able to raise and lower the glove box and suction rod assembly above a cask to be processed.

12. An installation adapted for emptying casks equipped with a double internal bag comprising an outer bag and an inner bag containing powdery products, the installation comprising a glove box comprised essentially of a bell at least partially made of a transparent material and provided with a lower, cask interface and an upper suction rod opening equipped with a sealing device which seals between said rod and the bell, and wherein the lower cask interface is provided with means adapted for interfacing with an upper part of a cask in a sealed manner and wherein a retaining device holds upper parts of the outer and inner bags, after they have been opened, against the lower cask interface, wherein the glove box is provided with a filtering device making it possible to keep the installation under a vacuum, and wherein the filtering device comprises two openings on a side surface of the bell, the openings being provided with two smooth tubes in which a filter is fitted in a sealed manner and wherein further, the two tubes are connected to an air circulation system.

13. A method of using an installation adapted for emptying casks equipped with a double internal bag comprising an outer bag and an inner bag containing powdery products, the installation comprising a glove box comprised essentially of a bell at least partially made of a transparent material and provided with a lower, cask interface and an upper suction rod opening equipped with a sealing device which seals between said rod and the bell, and wherein the lower cask interface is provided with means adapted for interfacing with an upper part of a cask in a sealed manner and wherein a retaining device holds upper parts of the outer and inner bags, after they have been opened, against the lower cask interface, the method comprising the following steps: opening the cask to be processed by removing its lid and placing the cask under the glove box, inserting a disposable sealing ring in the upper part of the outer bag and in the ring of the bell, opening the outer bag, lowering the glove box onto the cask until the glove box is in sealed contact with the cask, using the gloves, fixing the outer bag to the holding ring by means of the sealing ring, opening the inner bag and fixing the inner bag to the holding ring, withdrawing the bands from the gloves and emptying the cask using the suction rod, when the cask is empty, using the gloves to detach the inner bag and allowing the inner bag to drop inside the cask with the sealing ring, raising the glove box over a predetermined height while keeping the outer bag on the holding ring and closing the bag at two axially separated places using two ties, cutting the bag between these two places, dropping the lower part of the bag into the cask with the upper part remaining on the glove box, removing the empty cask, bringing a new cask into position and starting the method again except that, before fixing the outer bag on the holding ring, the remaining part of the preceding bag is removed through the opening of the glove box.

* * * * *